US005094210A

United States Patent [19]

Endres et al.

[11] Patent Number: 5,094,210

[45] Date of Patent: Mar. 10, 1992

[54] INTAKE AND FUEL/AIR MIXING SYSTEM FOR MULTI-CYLINDER, EXTERNALLY IGNITED INTERNAL COMBUSTION ENGINES

[75] Inventors: Helmut Endres, Herzogenrath; Helmut Thöne, Aachen; Heinz-Jakob Neusser, Alsdorf, all of Fed. Rep. of Germany

[73] Assignee: FEV Motorentechnik GmbH & Co. KG, Aachen, Fed. Rep. of Germany

[21] Appl. No.: 630,242

[22] Filed: Dec. 19, 1990

[30] Foreign Application Priority Data

Dec. 22, 1989 [DE] Fed. Rep. of Germany ..... 3942578

[51] Int. Cl.[5] ..... F02B 15/00

[52] U.S. Cl. ..... 123/432; 123/52 M

[58] Field of Search ..... 123/432, 308, 52 M, 123/52 MV, 52 MB

[56] References Cited

U.S. PATENT DOCUMENTS

| | | | |
|---|---|---|---|
| 4,488,531 | 12/1984 | Tadokoro et al. | 123/432 |
| 4,538,574 | 9/1985 | Lombardi | 123/432 |
| 4,548,175 | 10/1985 | Kawai et al. | 123/432 |
| 4,726,343 | 2/1988 | Kruger | 123/432 |
| 4,727,719 | 3/1988 | Mizutani | 123/432 |
| 4,741,295 | 5/1988 | Hosoya et al. | 123/568 |
| 4,765,297 | 8/1988 | Richter | 123/432 |
| 4,766,866 | 8/1988 | Takii et al. | 123/432 |
| 4,841,935 | 6/1989 | Yamada et al. | 123/432 |
| 4,860,709 | 8/1989 | Clarke et al. | 123/432 |

FOREIGN PATENT DOCUMENTS

| | | |
|---|---|---|
| 0098543 | 1/1984 | European Pat. Off . |
| 1576230 | 4/1970 | Fed. Rep. of Germany . |
| 3519143 | 12/1985 | Fed. Rep. of Germany . |

OTHER PUBLICATIONS

"Trends in emissions Control Technologies . . . " SAE Technical Paper Series No. 872164, by Kenny & Lyons, Nov. 1987.

"A New Low Pressure Single Point Gasoline Injection System ", Knapp et al., SAE Technical Paper Series No. 850293, Feb. 1985.

"Evaluation of Burned Gas Ratio (BGR) as a Predominant Factor . . . ", Toda et al., SAE Technical Paper Series No. 760765, Feb. 1976.

"Combustion System Development Trends for Multi--Valve . . . " Endres et al. SAE Technical Paper Series No. 900652 Feb./Mar. 1990.

"Automotive Powertrain in West Europe" Planning Research & Systems plc, 1987, no month provided.

*Primary Examiner*—David A. Okonsky

*Attorney, Agent, or Firm*—Watson, Cole, Grindle & Watson

[57] ABSTRACT

An intake and fuel/air mixing system for multi-cylinder externally ignited internal combustion engines with at least two inlet valves per cylinder, at least two separate intake pipe arms per cylinder assigned to the inlet valves, and fuel injection. The first intake pipe arms per cylinder are combined into a first group and other intake pipe arms per cylinder are combined into at least one other group. Each group is assigned one throttling member. The first group comprises a common fuel injection, and one injection each is assigned to the intake pipe arms or inlet ports of the other group or other groups. The throttling members of the individual groups are controlled in such a manner that for the region of low air flow rates the first group opens first and the other group or other groups are opened as a function of the speed and load with higher air flow rates.

13 Claims, 3 Drawing Sheets

INTAKE AND FUEL/AIR MIXING SYSTEM FOR MULTI-CYLINDER, EXTERNALLY IGNITED INTERNAL COMBUSTION ENGINES

BACKGROUND OF THE INVENTION

The invention relates to an intake and fuel/air mixing system for multi-cylinder, externally ignited internal combustion engines with at least two inlet valves per cylinder, at least two separate intake pipe arms for the inlet valves per cylinder, and fuel injection into the intake system.

In internal combustion engines of this kind the two inlet valves of each cylinder are usually connected to a common intake pipe and an injection nozzle is assigned to each cylinder. Such a design is relatively simple to build, but its drawback is that a load and speed dependent control of the charge movement in the intake pipe arms and in the cylinder is not possible since in this design a partial flow of the charge fed into the cylinder cannot be throttled. In addition, when the air flow rates are low, the velocity of the flow of the fresh air (or mixture with recirculated exhaust gas—EGR) is low so that the mixing of fuel and air is inadequate. Due to the rapidly released, large opening cross sections in multi-valve engines, residual gas content is high during idle and with low partial load. In this state, in connection with the low charge movement in the combustion chamber, unstable combustion and low efficiency are unavoidable.

A control of the charge movement in the cylinder that is adapted to the air flow rate can be achieved with intake systems that exhibit two completely separate intake pipe arms per cylinder. If one of these arms closes partially or totally when the air flow rates are low, the charge movement and the turbulence in the combustion chamber are significantly increased and thus, the combustion process is improved. The consistent design of such an intake system with completely separate intake pipe arms up to the inlet valves would, however, require twice the number of injection nozzles as compared to the current conventional systems. This design represents the most complicated and expensive solution from a manufacturing point of view.

SUMMARY OF THE INVENTION

The present invention is based on the problem of enabling, in a simple, economical and reliable manner, a load and speed dependent control of the flow movement in the intake pipe arms and thus in the cylinder while simultaneously mixing the fuel and air in an advantageous manner.

According to the invention, an intake and fuel/air mixing system for multi-cylinder, externally ignited internal combustion engines with at least two inlet valves per cylinder comprises at least two separate intake pipe arms per cylinder assigned to the inlet valves. Fuel injection is also provided. A group of first intake pipe arms per cylinder are combined into a first group and the other intake pipe arms per cylinder are combined into at least one other group. Each group is assigned one throttling member where the first group exhibits a common fuel injection, and one injection each is assigned to the intake pipe arms or inlet ports of the other group or other groups. The throttling members are controlled in such a manner that for the region of low air flow rates the first group opens first and the other group or other groups are opened as a function of the speed and load with higher air flow rates. With such a system important advantages can be attained.

In the region of low air flow rates, with high intake pipe vacuums and/or low engine speeds, better fuel/air mixing is achieved with central injection than with an individual injection. By metering the fuel through only one nozzle, the quantity dispersions from cylinder to cylinder are significantly less in this air flow rate region. Furthermore, the longer path of the fuel/air mixing process improves the mixture formation of the common injection. In particular, when the engine is warm, the mixing of fuel and air is improved. The result in the region of low air flow rates is better efficiency, lower pollutant emissions and improved performance when operated with lean fuel/air mixtures or with mixtures diluted with exhaust gas. In addition, the fuel enrichment with cold start and in the warm-up phase can be reduced. This offers additional advantages with respect to efficiency and emission of harmful substances.

In the region of higher air flow rates the use of individual injections on the second group or the other groups offers better design possibility of the intake pipe arm geometry, especially short, gas-dynamically good intake pipe arms with minimum throttling losses. Thus, good conditions to produce high specific outputs are created.

The advantages of central fuel/air mixing can be combined in an especially advantageous manner with the intake pipe arms of the first group, a feature that is desirable from a gas-dynamic view point. Thus, high torques with low engine speeds can be produced.

In connection with a suitable design or tuning of the intake system (intake pipe arm length, intake pipe arm diameter, plenum volume, inlet port geometry), optimal flow movement and structure (turbulence) for the fuel-/air mixing, combustion process in the cylinder, and optimal gas-dynamic, in the intake pipe can be generated.

Another advantage of the intake and fuel/air mixing system according to the invention is that the fuel/air ratio can be adjusted by varying the injected fuel quantities for the respective group or groups independently of one another. Thus, load and speed dependent, homogenous or nonhomogeneous cylinder charges can be generated, wherein stratified charge effects specified to increase the efficiency and reduce pollution can be utilized. In addition, possible fuel/air ratio dispersions of the first group with low intake pipe vacuums can be avoided by varying the injection period of individual injections within the second group. Thus, knock sensitivity of the engine, i.e. the tendency toward uncontrolled combustion processes, can be reduced. The consequence is higher torques and higher efficiency.

Preferably, the fuel quantity required when starting can be made available by actuating the fuel injections of the second group additionally. Thus, the injectors can be selected smaller and can be better adapted to the respective air flow rate. At the same time, account can also be taken of the requirements for mixing air and fuel with low air flow rates, i.e., especially during idle, as well as for high air quantities in the nominal output range.

If the fuel injection of the other group or other groups is independent of the fuel injection of the first group, this has the advantage that with varying pressure requirements from group to group in the fuel system, energetic advantages can be attained when generating pressure.

Preferably, the exhaust gas can be fed selectively into the first and/or the other group or other groups, where good equipartition of the exhaust gases among the individual cylinders of a group is targeted. At the same time, however, stratified effects in the cylinder can also be used. In this case, it is possible to concentrate the more ignitable mixture in the region of the spark plug. The improved ignition conditions lead to a more stable flammable phase and correspondingly to a more stable engine operation. As an alternative, higher exhaust gas recycling rates can be realized.

In an advantageous design, the common fuel injection of the first group occurs, seen in the inlet flow direction, from behind the common throttling member. The intake pipe vacuums existing with a partially or totally closed throttling member favor fuel evaporation.

Another possibility comprises the common fuel injection of the first group occurring, seen in the inlet flow direction, in front of the common throttling member. In this case, the advantage is achieved such that the throttling gap existing with a partially closed throttle flap promotes the thorough mixing of the injected fuel with the intake air through the high flow speeds existing at the gap, thus improving the mixing of fuel and air.

The fuel of the other group or other groups can also be injected into the cylinder. Thus, the dynamic engine performance can be improved. When accelerating, a faster response behavior can be obtained. When decelerating, wall deposit effects in the intake pipe can be avoided.

Another advantageous possibility lies in the fact that a throttling member per intake pipe arm can be provided to control the intake pipe arms of the individual groups in addition to, or as a replacement for, the common throttling members. By this measure the quantities between inlet valve and throttling member for the respective cylinder, when the second group is closed, are reduced. Thus, the residual gas content and consequently the smooth running of the engine are optimally affected.

Preferably, several identical intake systems for multi-cylinder internal combustion engines can be combined. Thus, individual components of the individual groups can also be used jointly.

BRIEF DESCRIPTION OF THE DRAWINGS

Preferred embodiments of the invention are described in detail with reference to the drawings, wherein.

DETAILED DESCRIPTION OF PREFERRED EMBODIMENTS

Figure 1:
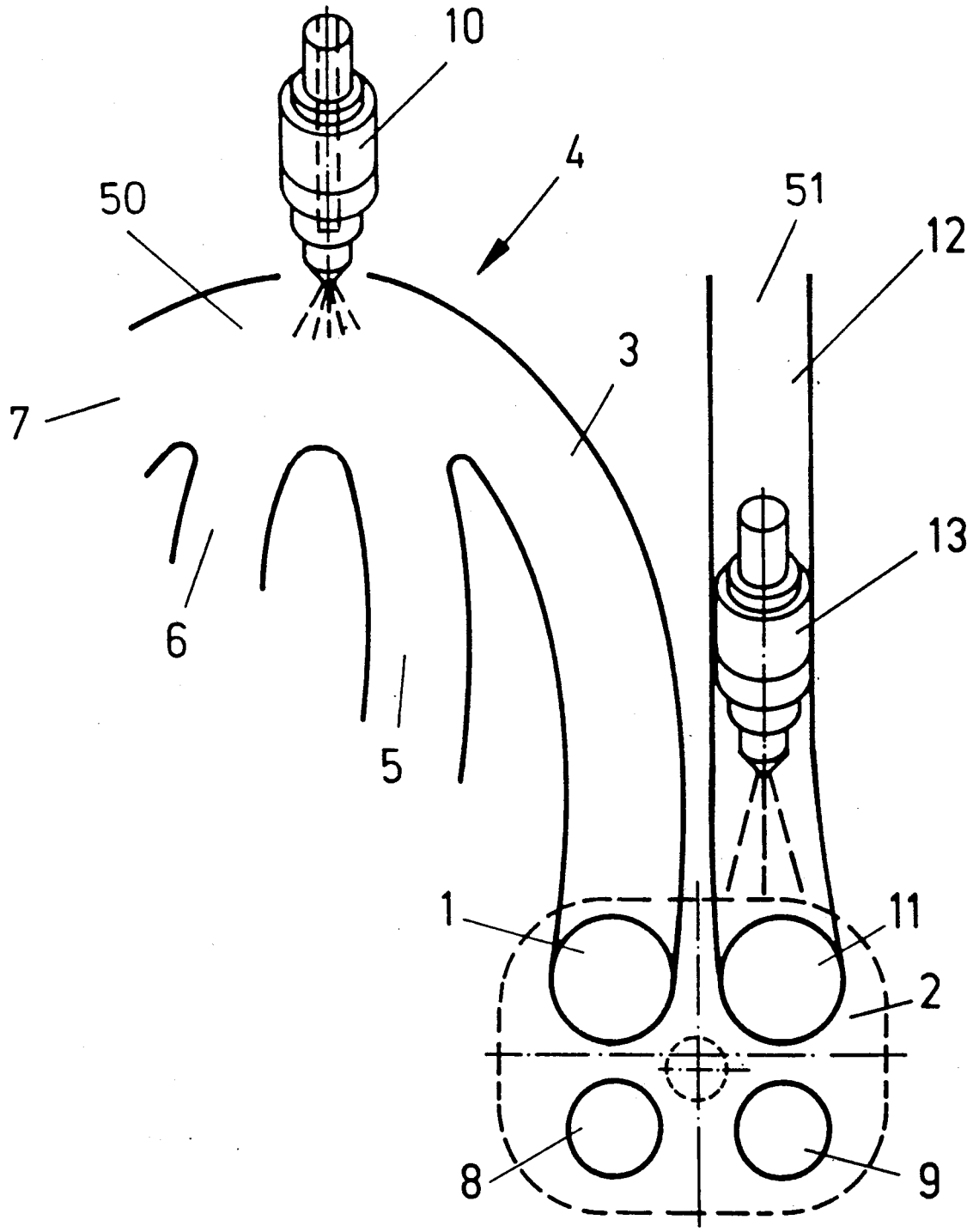
FIG. 1 shows schematically the assignment of intake pipe arms and injection nozzles to one cylinder of a multi-cylinder injection engine.

FIG. 1 shows schematically the connection of the intake pipe arms to the valves of one cylinder of a multi-cylinder internal combustion injection engine. A first inlet valve 1 of a cylinder 2 is connected to an intake pipe arm 3, which is part of a group 4 with other intake pipe arms 5, 6 and 7 of a four cylinder internal combustion engine, shown as an example. Outlet valves 8 and 9 are attached in a suitable manner to the exhaust gas system. Group 4 comprises a common fuel/air mixing member, which is represented by an injection nozzle 10. Group 4 also has a common throttling member (not illustrated).

A second inlet valve 11 is connected to another intake pipe arm 12, which can belong to a second group of intake pipe arms, whose other intake pipe arms are not illustrated. Preferably, the second group will also have a common throttling member (not illustrated). A fuel-/air mixing member is represented by injection nozzle 13, so that in the illustrated embodiment a separate fuel/air mixing member is assigned to the intake pipe arm 12. In view of the other intake pipe arms (not illustrated), there is flexibility when individual or also common fuel/air mixing members can be provided.

Operationally, the intake pipe arm group 4 is assigned to the region 50 of low air flow rates, whereas the second intake pipe arm group, of which intake pipe arm 12 is a part, is assigned to the region 51 of high air flow rates.

Figure 2:
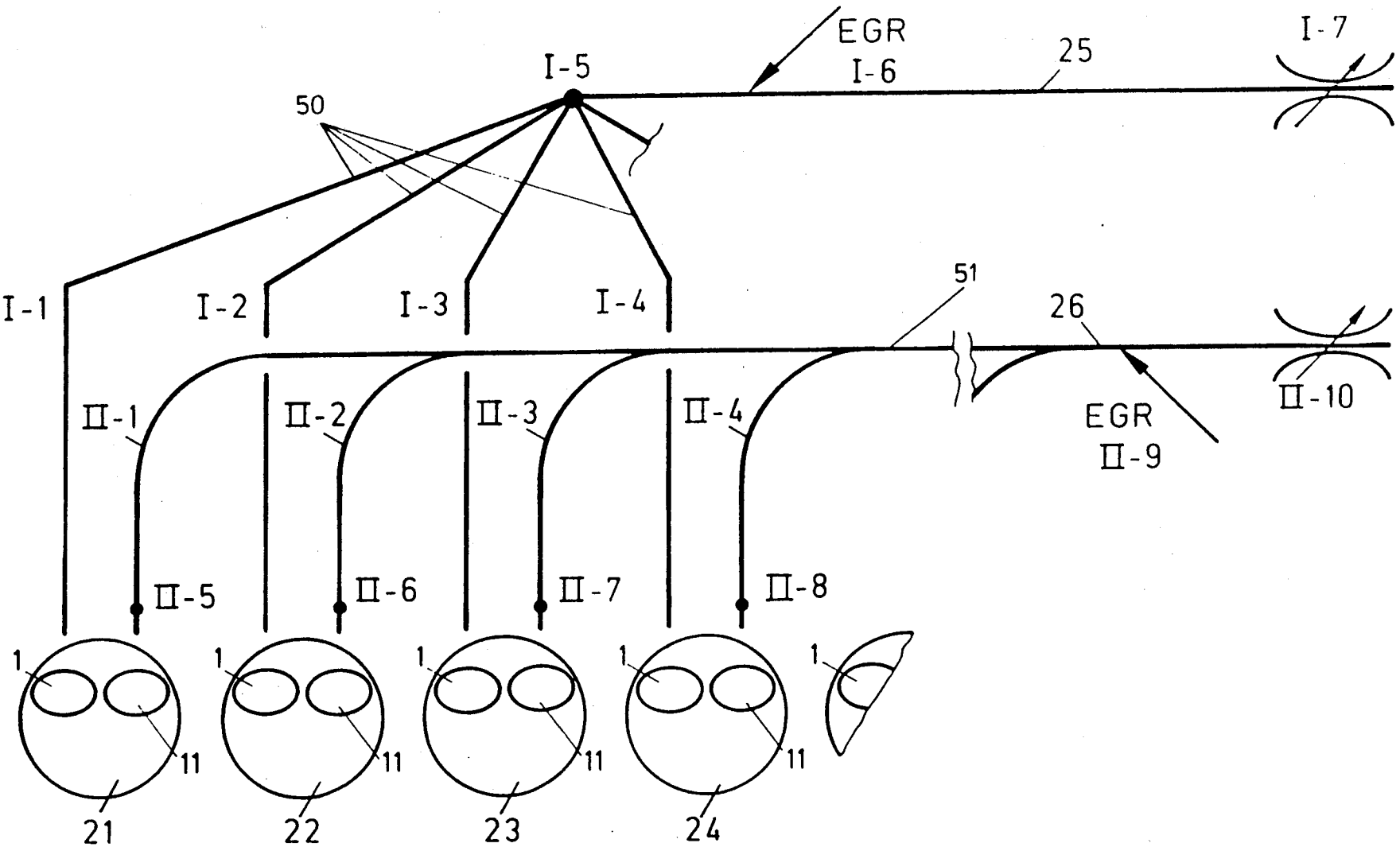
FIG. 2 shows schematically a design of a complete intake and fuel/air mixing system according to the invention.

FIG. 2 shows one embodiment wherein the first group of intake pipe arms exhibits a common fuel injection, and one injection each is assigned to the intake pipe arms or inlet ports of the second group.

In the schematic representation of variable flow intake pipe arms of the embodiment, a first intake pipe arm group 25 and a second intake pipe arm group 26 are assigned to cylinders 21, 22, 23 and 24 for the four cylinder engine, shown as an example. The first group 25 comprises intake pipe arms I-1, I-2, I-3, and I-4, and the second group comprises intake pipe arms II-1, II-2, II-3 and II-4. In each group, different intake pipe arms lengths and intake pipe arm cross sections can be realized.

The first intake pipe arm group 25 comprises a common fuel/air mixing member I-5, and a common exhaust gas recirculation EGR I-6 may exist. In the second intake pipe arm group 26 the fuel is fed into the intake pipe arms or inlet ports separated at II-5, II-6, II-7, and II-8. In addition, a common exhaust gas recycling II-9 may exist. In addition, there is the possibility of a common exhaust gas recycling for the first and second group upstream of a common throttling member (not illustrated), which can be designed as a register throttle flap.

The first intake pipe arm group 25 comprises a common throttling member I-7, and the second intake pipe arm group 26 also comprises a common throttling member II-10. Thus, the individual throttling members can be closed in an advantageous manner partially or completely independently of one another and thus, load and speed-dependent control of the charge movement in the intake pipe arms of the groups and in the cylinder is possible. Specific flow cross-sections and intake pipe arm lengths can also be controlled as a function of the load and speed.

In the embodiment shown in FIG. 1, the first intake pipe arm group 4 with intake pipe arms 3, 5, 6 and 7 is assigned, as stated, to the operating region 50 of low air flow rates. The intake pipe arm 12 and the three other intake pipe arms (not illustrated) are assigned to the operating region 51 of higher air flow rates. In a corresponding manner in the embodiment shown in FIG. 2, the intake pipe arms I-1, I-2, I-3 and I-4 of the intake pipe arm group 25 are assigned to the operating region 50 of low air flow rates, whereas the intake pipe arm group 26 with the intake pipe arms II-1, II-2, II-3 and II-4 is assigned to the operating region 51 of high air flow rates. According to the invention, the throttling members are controlled in such a manner that for the region of low air flow rates, the first group 25 opens first and the other group 26 (or the other groups) are opened as a function of the speed and load when the air flow rates are higher. In this manner, the advantages are achieved that in the region of low air flow rates, thus with high intake pipe vacuums and/or low engine speeds, better fuel/air mixing is achieved with a central injection than with a cylinder individual injection. Thus, in this operating region, better efficiency, lower pollutant emissions and improved performance are achieved when operating with lean mixtures or with mixtures diluted with exhaust gas. At the same time, the fuel enrichment with cold start and in the warm-up phase can be reduced.

In the region of higher air flow rates, the application of individual injections to the second group or to other groups offers a better design possibility of the intake pipe arm geometry, i.e. in particular, short, gas-dynamically good intake pipe arms with minimum throttle losses. Thus, good conditions to produce high specific outputs are created.

The respective flow movement and flow structure (turbulence) that is optimal from a combustion point of view can also be produced in the cylinder through the speed and load-dependent insertion of the second group.

Figure 5:
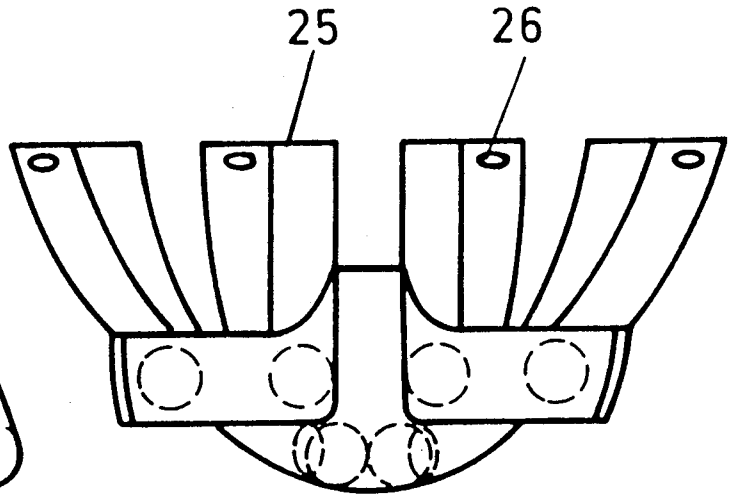
FIG. 5 is a top view of an embodiment of the intake and fuel/air mixing system according to FIG. 2.
Figure 4:
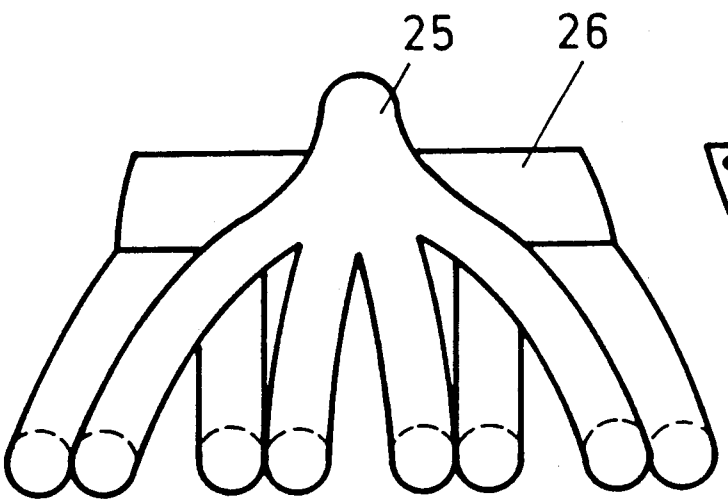
FIG. 4 is a rear view of an embodiment of the intake and fuel/air mixing system according to FIG. 2.
Figure 3:
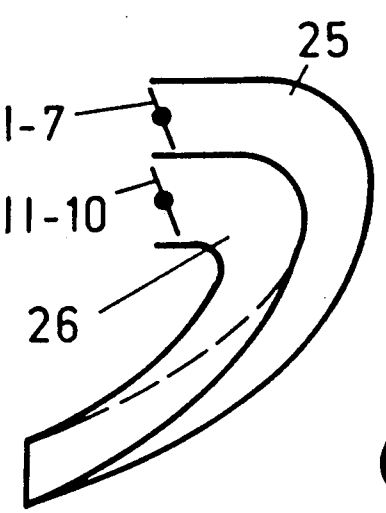
FIG. 3 is a side view of an embodiment of the intake and fuel/air mixing system and fuel/air mixing according to FIG. 2.

In FIGS. 3 to 5, spatial configuration of the intake pipe arm groups 25 and 26 is shown as an alternative embodiment. In so doing, the common throttling systems I-7 and II-10 of groups 25 and 26 can be recognized.

Although the systems in accordance with the present invention have been described in connection with preferred embodiments, it will be appreciated by those skilled in the art that additions, modifications, substitutions and deletions not specifically described may be made without departing from the spirit and scope of the invention defined in the appended claims.

What is claimed is:

1. Intake and fuel/air mixing system for multi-cylinder, forced ignited internal combustion engines with at least two inlet valves per cylinder, comprising:

at least two separate intake pipe arms per cylinder connected to the inlet valves;

wherein first intake pipe arms per cylinder are combined into a first group and other intake pipe arms per cylinder are combined into at least one other group, each group having one throttling member, said first group exhibiting a common fuel injection, and a fuel injector each being connected to individual intake pipes of the at least one other group, said throttling members being controlled in such a manner that for low air flow rates the first group opens first and the at least one other group is opened as a function of the speed and load with higher air flow rates; and the spatial distances between the fuel injector and the inlet valves in the first group being larger than in the at least one other group.

2. Intake and fuel/air mixing system as in claim 1, wherein the fuel injectors of said at least one other group are independent of the fuel injection of the first group.

3. Intake and fuel/air mixing system as in claim 1, further comprising systems to feed exhaust gas into at least one of the groups.

4. Intake and fuel/air mixing system as in claim 1, wherein the common fuel injection of the first group is designed in inlet flow direction downstream the common throttling member.

5. Intake and fuel/air mixing system as in claim 1, wherein the common fuel injection of the first group is designed in inlet flow direction upstream the common throttling member.

6. Intake and fuel/air mixing system as in claim 1, further comprising a throttling member per intake pipe arm to control the intake pipe arms of the individual groups in addition to the common throttling members.

7. Intake and fuel/air mixing system as in claim 1, wherein several identical intake systems for multi-cylinder internal combustion engines are combined.

8. Process to operate an intake and fuel/air mixing system for multi-cylinder, forced ignited internal combustion engines with at least two inlet valves per cylinder, at least two separate intake pipe arms per cylinder connected to the inlet valves, wherein:

first intake pipe arms per cylinder are combined into a first group and other intake pipe arms per cylinder are combined into at least one other group, each group having one throttling member, where the first group exhibits a common fuel injection into the intake system, and one injection each is connected to the individual intake pipe arms of the at least one other group, the spatial distances between the fuel injector and the inlet valves in the first group being larger than in the at least one other group, and the throttling members are controlled in such a manner that for low air flow rates the first group opens first and the at least one other group is opened as a function of the speed and load with higher air flow rates.

9. Operating process as in claim 8, wherein the fuel/air ratio is adjusted by varying the injected fuel quantities to generate a stratified charge for the respective group or groups independently of one another.

10. Operating process as in claim 8, wherein the fuel quantity required when starting is made available by actuating the fuel injections of the other group or groups additionally.

11. Operating process as in claim 8, wherein the fuel of the other group or other groups is injected into the cylinders.

12. Intake and fuel/air mixing system as in claim 1, further comprising a throttling member per intake pipe arm to control the intake pipe arms of the individual groups as a replacement for the common throttling members.

13. Intake and fuel/air mixing system as in claim 1, further comprising a system to feed exhaust gas into the at least one other group of intake pipe arms.

* * * * *